US005192239A

United States Patent [19]

Graser

[11] Patent Number: 5,192,239

[45] Date of Patent: Mar. 9, 1993

[54] METHOD AND APPARATUS TO MAKE A DISCHARGE VESSEL FOR A SODIUM HIGH-PRESSURE DISCHARGE LAMP

[75] Inventor: Wolfram Graser, Munich, Fed. Rep. of Germany

[73] Assignee: Patent Treuhand Gesellschaft fur Elektrische Gluhlampen m.b.H., Munich, Fed. Rep. of Germany

[21] Appl. No.: 786,514

[22] Filed: Nov. 1, 1991

[30] Foreign Application Priority Data

Nov. 27, 1990 [DE] Fed. Rep. of Germany ..... 4037721

[51] Int. Cl.[5] ..... H01J 9/395

[52] U.S. Cl. ..... 445/21; 445/26; 445/40

[58] Field of Search ..... 445/26, 3, 40, 57, 21, 445/17, 66

[56] References Cited

U.S. PATENT DOCUMENTS

| | | | |
|---|---|---|---|
| 2,660,004 | 11/1953 | Daley | 445/66 |
| 3,973,816 | 8/1976 | Van Bakel et al. | 445/21 |
| 4,156,550 | 5/1979 | Furukubo et al. | 445/53 |
| 4,866,341 | 9/1989 | Ichiga et al. | 313/623 |
| 5,022,882 | 6/1991 | White et al. | 445/26 |

FOREIGN PATENT DOCUMENTS

| | | | |
|---|---|---|---|
| 0093383 | 11/1983 | European Pat. Off. . | |
| 0122051 | 10/1984 | European Pat. Off. . | |
| 0122052 | 10/1984 | European Pat. Off. . | |
| 63-53831 | 3/1988 | Japan | 445/21 |
| 1205871 | 9/1970 | United Kingdom . | |
| 1363238 | 8/1974 | United Kingdom . | |
| 1465212 | 2/1977 | United Kingdom . | |
| 2186739 | 8/1987 | United Kingdom | 445/26 |

*Primary Examiner*—Richard K. Seidel
*Assistant Examiner*—Jeffrey T. Knapp
*Attorney, Agent, or Firm*—Frishauf, Holtz, Goodman & Woodward

[57] ABSTRACT

The method is suitable to make sodium high-pressure discharge lamps operating operating under saturated condition. After placing and melt-sealing a first electrode system into the discharge vessel, sodium is introduced in the form of $NaN_3$ through the second end of the vessel. Upon heating of the second end, and due to heat conduction, the $NaN_3$, collected at the first end, dissociates, resulting in a sudden pressure rise due to liberation of nitrogen within a vacuum. As soon as the nitrogen has dissipated, noble gas to cool the first end is introduced, and the second melt seal is then made. The noble gas may, at the same time, form an ignition gas, or a gas mixture for the discharge lamp. One or more half-finished lamps are preferably held in a holder structure which has vertical bores leaving a gap of between 0.2 to 3 mm between the wall surface of the bore and the vessel and, as such, are introduced into a vacuum furnace, where the pressure can be monitored.

18 Claims, 5 Drawing Sheets

METHOD AND APPARATUS TO MAKE A DISCHARGE VESSEL FOR A SODIUM HIGH-PRESSURE DISCHARGE LAMP

Reference to related patent and publication: European Patent 122 052, white U.S. Pat. No. 4,156,550, Furukubo et al.

FIELD OF THE INVENTION

The present invention relates to sodium high-pressure discharge lamps, and more particularly to a method and a structure or apparatus used in a the method to make the discharge vessel for such a lamp, and especially for such a lamp which operates as a saturated high-pressure discharge lamp.

BACKGROUND

A known process to make a sodium high-pressure discharge lamp which operates under saturated conditions, for short a saturated sodium high-pressure discharge lamp, uses a filler which has a sodium amalgam constituent. European Pat. No. 122 052, White, describes a process in which, after melt-sealing a first electrode system in a discharge vessel, in which the electrode system is solid, that is, does not have an exhaust tube or stub, a fill of sodium amalgam is introduced. After flushing and filling with a noble gas, the second electrode system is fitted on the discharge vessel and melt-sealed. This system requires extensive use of a glove box in which an inert atmosphere is present. The filling system thus becomes expensive and complex.

U.S. Pat. No. 4,156,550, Furukubo et al, describes a filling method for use in unsaturated sodium high-pressure lamps. Sodium is introduced in form of a sodium azide. $NaN_3$. The sodium azide is dissolved in a solvent. The solvent is introduced into a container and the solvent then is evaporated. Subsequently, the container is introduced into the pumping or exhaust tube of an electrode system, which had been secured to the discharge vessel. At the same time, mercury in form of a titanium containing compound is introduced into the pumping tube. After closing, the pumping tube is heated, in steps, so that the sodium azide will dissociate, liberating sodium and mercury. This process is complex, time-consuming, and requires numerous production steps. It is limited to filling of only minute quantities of sodium azide for example 0.02 to 0.153 mg per cubic centimeter of the discharge vessel. It is not suitable for saturated sodium high-pressure lamps.

THE INVENTION

It is an object to provide a method and an apparatus carrying out the method, to make a discharge vessel for a sodium high-pressure discharge lamp, particularly for a sodium high-pressure discharge lamp operating under saturated condition, which is simple, time-saving, easily reproducible, and is especially suitable for mass production of lamps in large quantities.

Briefly, two electrode systems are first made, as well as the discharge vessel, having two open ends. The electrode systems include blanks of glass melt or glass solder, in solid form, for subsequent use to melt-seal the electrode systems to the vessel. One of the electrode systems is then introduced into one open end of the vessel and melt-sealed to the vessel by means of the glass melt or solder mass which was previously attached thereto, to form a subassembly. A fill which includes sodium is then introduced into the subassembly, for example in form of pellets, pills or the like, of $NaN_3$. Thereafter, the second electrode system is introduced into the second still open end of the vessel.

The second end, with the electrode system therein, is then heated and, while carrying out the heating step, the pressure arising in the vessel is monitored. When a sharp pressure rise in form of a pressure pulse is sensed, which is indicative of the dissociation of the sodium from the nitrogen of the previously introduced $NaN_3$, and after decay of the pressure pulse, a noble gas or a mixture of noble gases is introduced into the vessel. The second electrode system is then melt-sealed into the vessel. This melt-sealing step can be carried out between the steps of heating of the second end and the sensing of the decay of the pressure pulse. Thereafter, the discharge vessel is cooled.

The method has the advantage that it can be used with both standard types of electrodes—namely hollow electrodes in form of electrode tubes, which permit gas exchange through the electrode; or with solid electrodes, in which the heating and pressure sensing steps are preferably all carried out within the same oven or furnace.

In accordance with a feature of the invention, the pre-assembled lamp structure, that is, the structure which includes the discharge vessel after the first electrode has been melt-sealed thereinto and, for example, before the second electrode system is heated, the vessel is placed in a reception die or holder which is formed with one or, for a plurality of lamps, a plurality of essentially vertical bores to hold the discharge vessel in which the diameter of the bore is between 0.4 mm to 6 mm larger than the outer diameter of the discharge vessel and, preferably, has a depth of at least one-third of the length of the discharge vessel. This reception structure or holder forms a heat sink which is highly effective in controlling the relative temperature conditions, and hence pressure conditions of and in the vessel.

The possibility that sodium azide can be used also in the manufacture of saturated sodium high-pressure discharge lamps previously had not been realized by industry and workers skilled in this field.

In accordance with a feature of the invention, the sodium is introduced in the form of sodium azide into the ceramic discharge vessel, after the first electrode system has been secured and melt-sealed thereto. Upon subsequent melt-sealing of the second electrode system, the heating of the first end of the vessel, due to heat conduction in the ceramic material of the discharge vessel, is used to dissociate the sodium azide therein. In contrast to the disclosure of the afore-discussed U.S. Pat. No. 4,156,550, Furukubo et al, separate apparatus for heating are not needed, resulting additionally in the saving of energy costs. Further, and entirely unexpectedly, this also permits substantial reduction of the duration of the filling process step.

In accordance with a feature of the invention, the surprising possibility has been used that the disassociating process at one end of the vessel can be combined with a melt-in process at the other end. Initially, it appeared that this was possible only with rather low power types of lamps, for example in the order of about 70 W. It has been found, in the meanwhile, that the method can be carried out in such a manner, and is so flexible, that it can be used effectively with many types, and probably all current types of saturated sodium high-pressure discharge lamps, even lamps having a power rating of up to 1000 W.

The process in accordance with the invention has another advantage, namely that the production steps for the manufacture of discharge vessels which contain amalgam need be modified only slightly.

A further advantage of the method is the ability to use existing melting furnaces of customary type, without causing space problems in the furnaces by additional heating apparatus. Holders or receptors to hold the discharge vessels are matched to the volume of the furnace. Introducing additional heating apparatus is difficult, since the required space cannot usually be found. The dead volume of the furnace should be as low as possible in order to permit economical handling of the fill gas, which is of particular importance when xenon is used, which is expensive.

The process in accordance with the present invention has the further advantage that sodium need not be used in its pure form. Pure sodium, as a solid or as a liquid, is difficult to handle. Due to its high reactively, it must be added in a glove box. When used as a solid, the material, due to its adhesive characteristics, causes problems. Properly dosing a liquid is complex, since the sodium must be held in liquid condition in a warm fluid bath. Sodium drops have the undesirable characteristics of adhering at dosing tubes or the ceramic wall of the discharge vessel by adhesive forces.

In contrast to the use of sodium as such, sodium azide, $NaN_3$, is insensitive with respect to air and can be easily handled. The method in accordance with the present invention, thus, and depending on the type of electrode used, can be carried out without use of a glove box.

The method of the present invention permits the manufacture of sodium high-pressure discharge lamps which are free from mercury, without use of a glove box, in large mass production quantities. These lamps, particularly when free from mercury, are used for general illumination and are particularly suitable due to their environmental acceptability and absence of toxic components When carrying out the manufacturing process for sodium high-pressure lamps in accordance with the present invention, a first electrode system is melt-sealed in the discharge vessel, typically of aluminum oxide, be means of a glass solder or glass melt, by heating in a melt furnace. This forms a subassembly. Thereafter, the $NaN_3$ is filled, which can be carried out in free air or, if one wishes, within a glove box. The $NaN_3$ is introduced, preferably, in form of pills, pellets or granules. The use of commercial powder has not been found suitable, since the danger may occur that upon filling the powder will adhere to the wall of the discharge vessel or on or below the electrode therein. The result would be premature dissociation and vaporization of the sodium or incomplete dissociation. This is the reason why the $NaN_3$ is preferably introduced in the form of cylindrical or essentially spherical pills or pellets. Pills of 2 mg or 5 mg are suitable, for example. Depending on the type of lamp, one to five pills are usually used.

The pills or pellets will have a diameter of about 0.7 to 2 mm. This value is determined by the realization that the pills must reach the region between the wall of the vessel and the electrode system which has already been melt-sealed therein at the first end of the vessel. When introducing the pills, it is recommended to hold the discharge vessel at an inclination. Sliding of the pills or pellets along the inner wall of the vessel can be assisted by slight shaking, tapping or gentle knocking thereagainst.

After filling the vessel, the second electrode with the glass melt ring is fitted to the second, upper end of the discharge vessel. Thereafter, the discharge vessel is placed in the bore of the holder or reception element. The second end of the vessel is then heated in a melting furnace. In this phase, the melting furnace is placed under vacuum. It is not necessary to avoid any touching of the discharge vessel with the wall of the reception element or holder, since the engagement would be only at small regions or points, and any premature cooling of the discharge vessel, particularly in a vacuum, can be neglected. The heat transmission by radiation between the discharge vessel and the receptor element or holder likewise can be neglected.

The vessel will, of course, heat; due to heat conduction in the wall of the discharge vessel, the lower end of the vessel which is in the receptor or holder will be heated; this is the region where the sodium azide is placed. The heating energy is held at an essentially constant level. When the temperature at the first end of the vessel, typically after heating from between about 1–5 minutes, has reached about 320° C., the sodium azide will dissociate to sodium and nitrogen. The time taken from the beginning of heating until the sodium azide dissociates depends on the length of the discharge vessel and the heat conductivity of the ceramic material, which is typically $Al_2O_3$. Entirely surprisingly, and advantageously for the process, the heat conductivity is just right and has just the proper value so that the temperature required to dissociate the sodium azide can be reached in the optimum heating times for this process.

Upon dissociation of the sodium azide, 1 mg $NaN_3$ will result in about 0.35 mg sodium. The nitrogen which is formed escapes through the upper end of the discharge vessel in the furnace and is pumped off. This results in a sudden rise in pressure within the melt furnace, having a duration of between about 30–60 seconds. Complete dissociation of the sodium azide is indicated by a subsequent pressure drop to a predetermined base value. When the base value, at least approximately, is reached, a noble gas or mixture of noble gases is introduced into the melt furnace and hence into the discharge vessel.

The noble gas has two tasks, namely first by cooling inhibiting a further heating of the first end of the discharge vessel due to the heat which continues to be supplied by the second end and, of course, its operating characteristics within the lamp. The temperature of the first, already finished end, during the heating process, preferably should not exceed about 400° C., since otherwise a substantial portion of the sodium which has been formed, may vaporize.

The gas introduced into the vessel, besides heating, will also have the customary function of an ignition gas, as will appear in detail below.

The cooling effect of the introduced gas can preferably be enhanced by careful selection of the relative dimensions of the receptor or holder for the discharge vessel with respect to the discharge vessel as such. The essential parameters are the diameter and the depth of the bore of the receptor or holder. The depth of the bore should be between about $\frac{1}{3}$ to $\frac{2}{3}$ of the length of the discharge vessel, and the gap between the discharge vessel and the bore should be between 0.2 to 3 mm, which means that the bore should be between 0.4 to 6 mm larger than the diameter of the discharge vessel.

Upon introducing the gas into the furnace, the heat conduction between the discharge vessel and the receptor rises rapidly, in form of a rapid pulse, so that the temperature rise at the first end of the discharge vessel will be stopped at about 350° C., and may even reverse. This prevents noticeable vaporization of the sodium. Lastly, the discharge vessel is cooled. The cooling step can also be carried out while the vessel is still within the melt furnace, so that the entire process need not use a glove box.

The process, in accordance with the present invention, can be carried out in various forms.

A first variant or form of the process is preferred for small discharge vessels in lamps of low power, for example of about 70 W. It is possible, and even desirable, to use a gas which is, simultaneously, the cooling gas and the ignition gas for the fill of the discharge vessel. The electrode systems will be a closed system, for example a closed tube, particularly a niobium tube, a solid rod or pin, or an integrated electrode plug system in form of a Cermet, as well known in sodium high-pressure discharge lamp construction. After seating the second electrode system, the second electrode end is heated in the melt furnace to a temperature just below the melting point of the glass solder or glass melting material. After dissociation of the sodium azide, and pressure drop back to base value, a noble gas is introduced into the melt furnace which, as noted above, also has the effect of a cooling gas. By increasing heating energy, the glass melt will become fluid and will seal the second end of the discharge vessel. This step requires about 0.5 to 2 minutes. Introduction of cooling gas had already been terminated, so that a portion thereof is included in the discharge vessel, as desired, and thus will take over the well known function of an ignition and buffer gas. A suitable noble gas is, preferably, xenon, which ensures particularly high light output. Xenon, however, is expensive. Rather than using xenon, an Ne/Ar—Penning mixture can be used, which has better cooling effect and particularly good ignition characteristics.

In this first embodiment, heating of the second end of the discharge vessel in the melt furnace has two purposes:

(1) melting-in of the second end and the electrodes thereof; and (2) dissociation of the sodium azide at the first end.

Introduction of the gas also has a dual purpose:

(1) cooling of the first end; and (2) filling of the vessel with the ignition gas.

This embodiment uses the melting and gas introduction steps for dual purposes, thus ideally combining, synergistically, different effects, so that the method is particularly time-saving and cost-effective.

A second embodiment of the method in accordance with the present invention is particularly suitable for discharge vessels in which at least one of the electrode systems has an exhaust tube associated therewith, and is thus particularly suitable for relatively long discharge vessels of high power, for example 1000 W. In this embodiment, only the cooling effect of the gas is important upon introduction of the noble gas after the pressure pulse has decayed. Preferably, a noble gas with good heat conductivity, for example argon, is used. Argon has the advantage with respect to xenon that it is very inexpensive.

After fitting of the second electrode system, the temperature at the second end of the discharge vessel is raised to that above the melting temperature of the glass melt or glass solder, by using high heating energy. After making the second melt, the temperature is dropped, by decreasing the heat energy just under the solidification temperature of the glass solder, and the heat energy is held constant. This provides for further heating of the first end of the vessel until the sodium azide dissociates. The second melt—in contrast to the first embodiment—thus is already made. The pressure pulse is then sensed and, after decay to the base value, heating is discontinued and, preferably, at the same time the cooling gas is introduced into the melt furnace. Since the discharge vessel retains metallic sodium, the discharge vessel must be removed from the melt furnace without being exposed to ambient air, preferably within a glove box.

The second embodiment has the advantage that, after taking the discharge vessel out of the furnace, additional substances or additives can be added to the fill, for example if desired mercury, since the pumping or exhaust tube is still open. Finally, the ignition gas is filled through the pumping stub or tube, and the pumping tube or stub is closed, for example tipped off.

DRAWINGS

Figure 1:
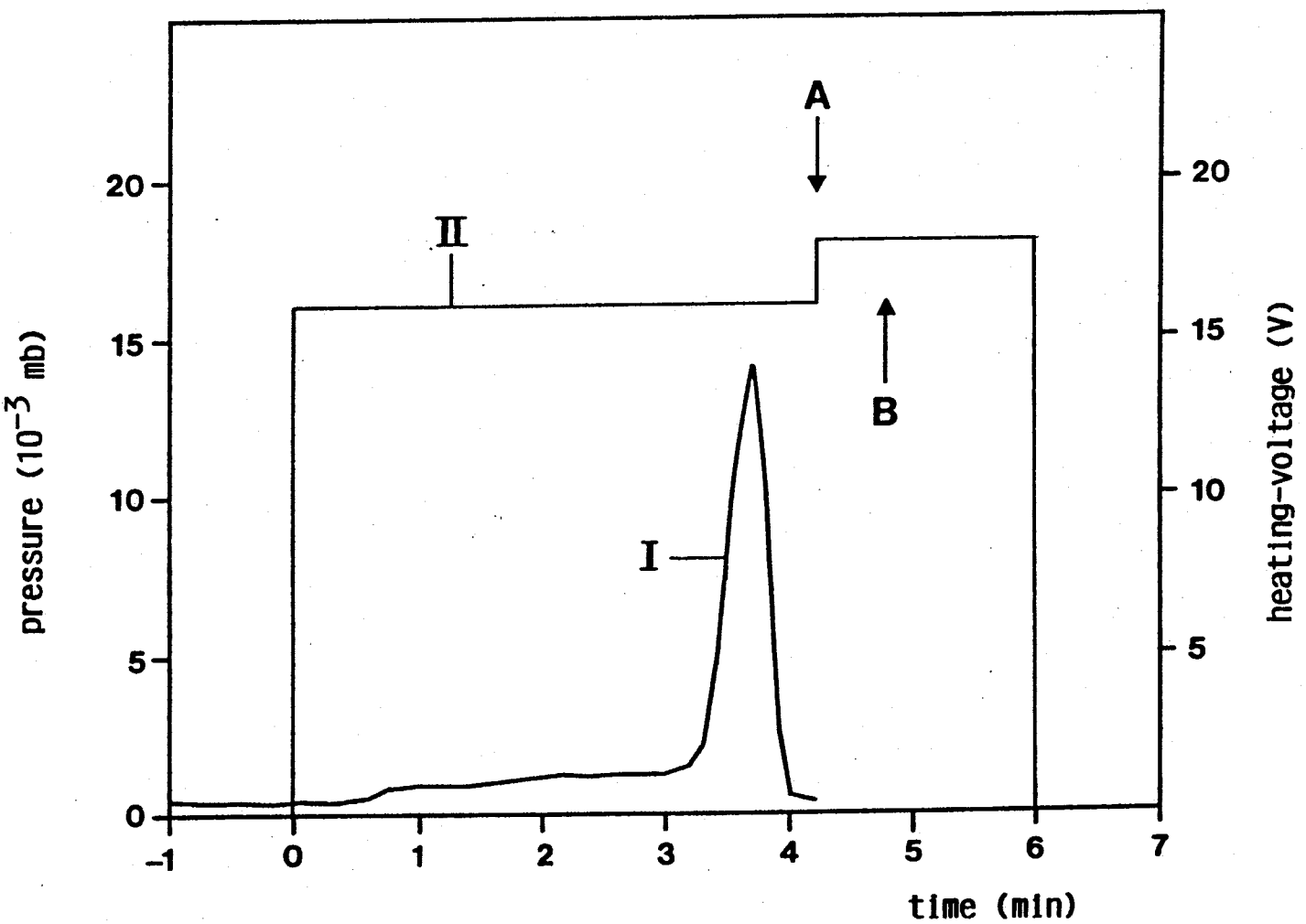
FIG. 1 is a diagram, with respect to time (abscissa) showing in curve I, with the associated left ordinate, the pressure within a furnace, and the voltage at a heating element by curve II and the right side ordinate, for a 70 W sodium high-pressure lamp, when using the first embodiment, with solid or closed electrodes.
Figure 2:
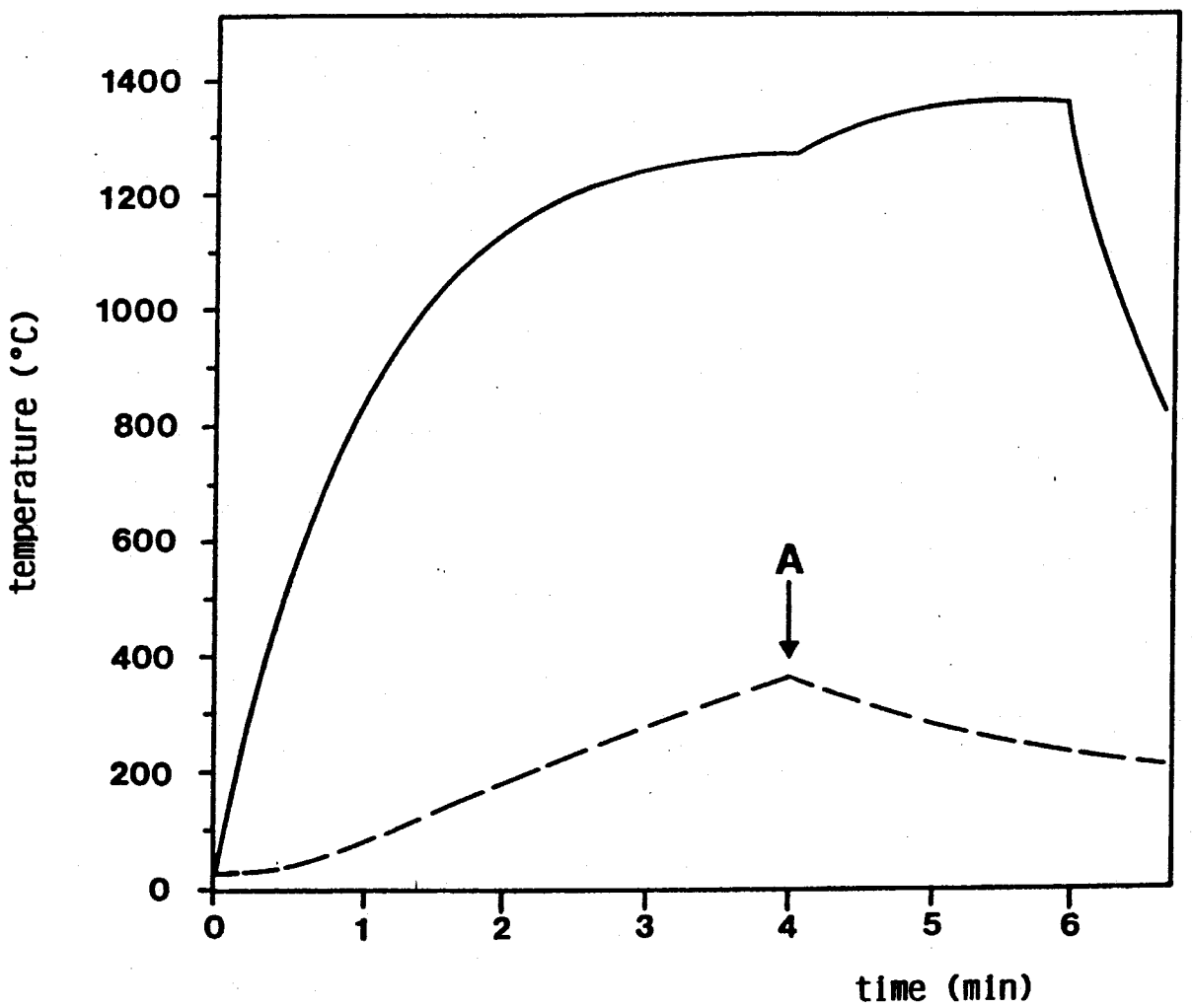
FIG. 2 is a diagram with respect to time (abscissa), of the temperature (ordinate) at the second end of the discharge vessel shown by the solid-line curve, and at the first end of the discharge vessel, shown by the broken-line curve.
Figure 4:
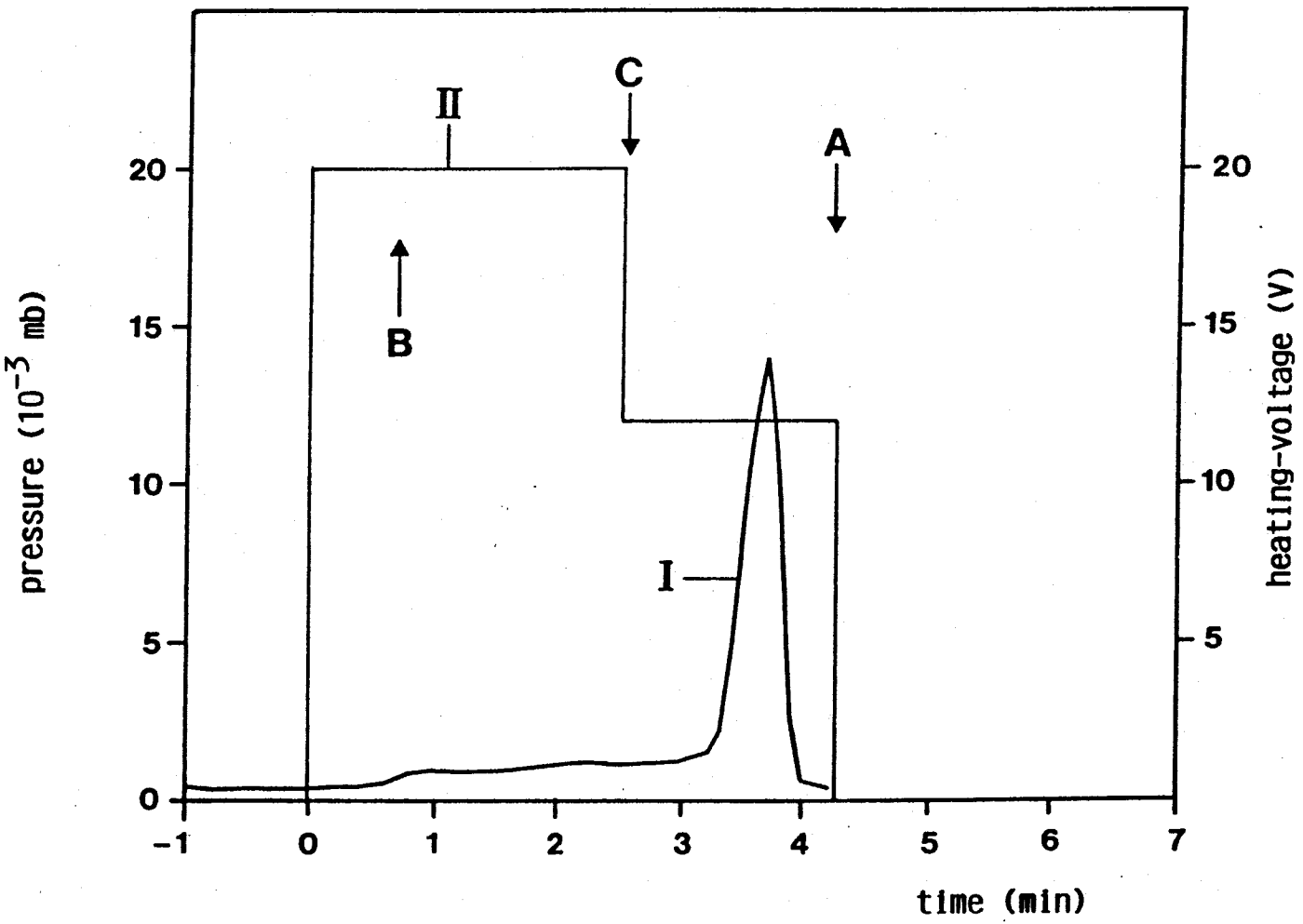
Figure 5:
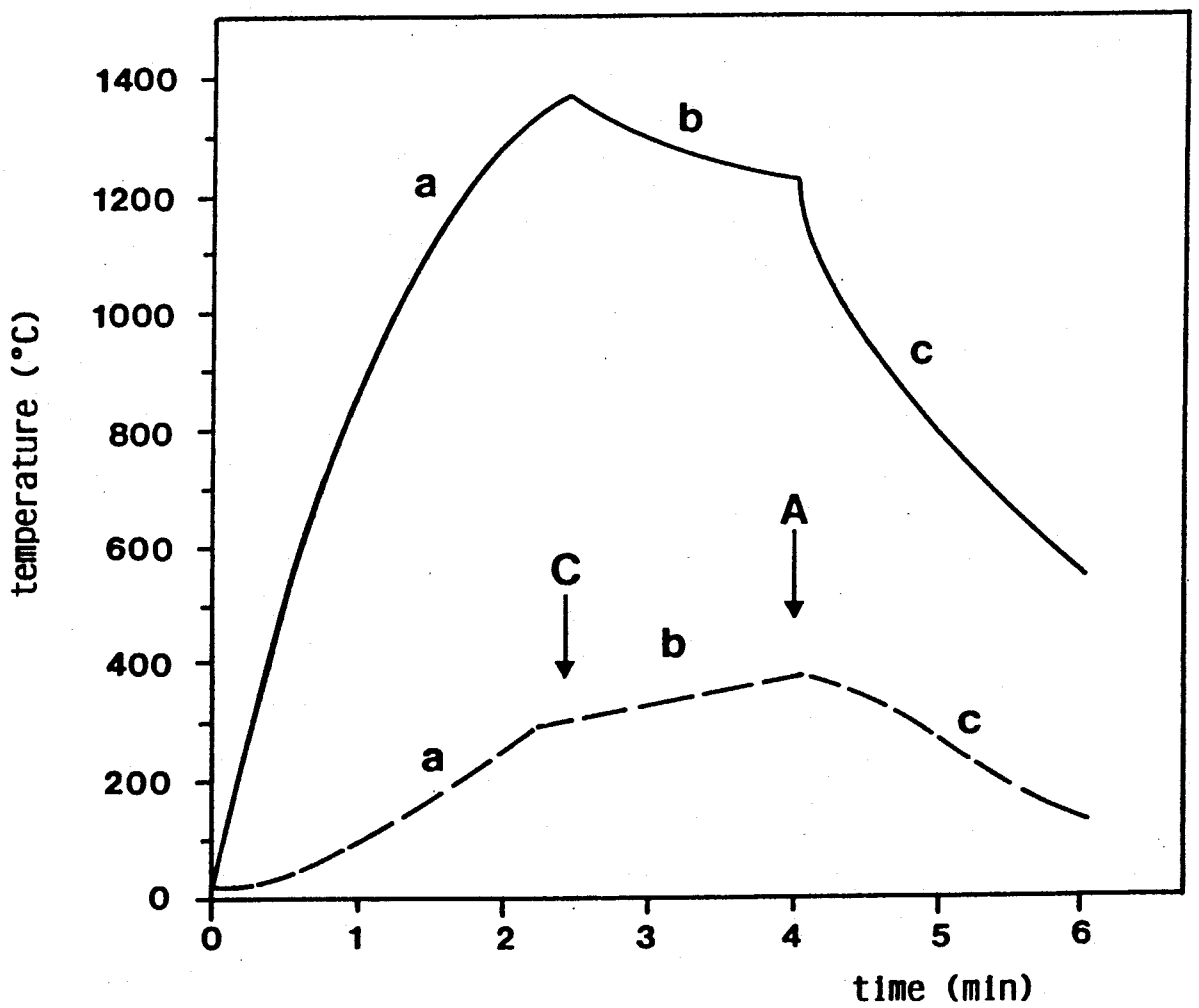

FIG. 4 is a diagram similar to the diagram of FIG. 1, and illustrating, with respect to time, pressure (curve I) and voltage at a heating element (curve II) for a 70 W sodium high-pressure discharge lamp having at least one hollow or pumpable electrode; and FIG. 5 is a diagram similar to FIG. 2 illustrating, with respect to time, the temperature at the second end—solid line and the first end—broken line—of the discharge vessel of FIG. 4.

DETAILED DESCRIPTION

The manufacture of sodium high-pressure discharge lamps, of various types, will be described with reference to the drawings.

EXAMPLE 1, WITH REFERENCE TO FIGS. 1 AND 2

The lamp uses closed or solid electrodes, has a power rating of 70 W, and will be made in accordance with the first embodiment.

Initially, the two electrode systems are provided, which includes electrode shafts, for example formed of a closed niobium tube, at the end of which a tungsten pin is welded. At the discharge side of the tungsten pin, a wrap or winding is applied. A glass solder or glass melt ring is seated on the niobium tube generally centrally of its longitudinal extent.

The discharge vessel is a ceramic tube made of $Al_2O_3$, closed off, vacuum-tightly, with a vacuum-tight sintered plug likewise of $Al_2O_3$, at each end. The plugs, each, have a central opening. In the central opening of a first plug, a first electrode system together with the glass solder or glass melt ring is fitted, and by heating in any suitable heating arrangement, melt-sealed therein. The heating system may, for example, be a melting furnace, which can be the same one which is used for the second melt connection.

The vessel, now closed off at one end and having one electrode therein, is cooled. Four sodium azide pellets of 0.9 mm to 2 mm length, are introduced through the opening in the second end of the vessel. The vessel is held at an inclination, so that the pills can slide or roll downwardly along the wall of the vessel until they reach the ceramic plug below the first electrode system. The sliding or rolling of the pellets can be assisted by slight tapping, shaking or knocking against the vessel. The size of the pills must be so small that they cannot jam against each other or pile up in the region between the electrode wraps or windings and the wall of the vessel. This filling of the sodium azide pills can be carried out in free air.

The so prepared vessel, with the electrodes and the pills therein, is fitted in the bores of a receptor or holder. Thereafter, the second electrode system, including the glass solder or glass melt material is loosely seated on the now vertically positioned discharge vessel.

The receptor or holder, essentially, is a solid rail which can be straight or in ring form, made of metal, having at its upper side at least one, and for numerous lamps, a plurality of essentially vertical bores to receive the discharge vessels. Details will be described below in connection with FIG. 3. The vessels with one electrode can be placed into the holder at room temperature. If necessary, they can be pre-cooled.

To make the second melt, the holder or receptor is introduced into a furnace which can provide a vacuum of about $10^{-4}$mb. The furnace, with the holder therein, fit together in such a manner that the volume of the furnace to be filled with xenon is as low as possible.

An electrically operated resistance heater 9, for example in form of a U-shaped graphite element, or any other heating system, for example heating coils, or a $CO_2$ laser, is then used to heat the upper second end of the discharge vessel with a constant heating power for about 4 minutes.

Reference is now made to FIGS. 1 and 2, in which FIG. 1 shows the pressure relationship, curve I and left ordinate, and the heating energy, curve II and right ordinate, in dependence on time, to melt in the second end of the discharge vessel. FIG. 2 clearly shows that with essentially constant heating energy being applied for about 4 minutes, the upper second end of the discharge vessel is heated, see FIG. 2, solid curve. The duration of this pre-heating phase, in dependence on type of lamp, may take between 1 and 6 minutes, in which the upper end of the discharge vessel will reach a temperature of about 1250° C. This temperature is roughly 50° C. below the melting temperature of the glass solder or glass melt which is at about 1300° C. This temperature of 1250° C. is, generally, determined by the consideration that the glass melt or glass solder material must be degassed, but still should not melt. The temperature to be selected, thus, depends on the type of the glass melt or glass solder material which, typically, has melting temperatures of between 1100° C. to 1300° C.

In the pre-heating phase, heat is transmitted through the ceramic material of the discharge vessel from the upper, second end, to the lower, first end of the vessel, where the sodium azide is located. After about 3 minutes—in the example shown in FIG. 2 as illustrated by the broken line thereof—the lower end of the vessel will reach a temperature of about 320° C., in which the sodium azide begins to dissociate. The evolution of nitrogen can be sensed by a sharply noticeable rise of pressure in the evacuated melt furnace, see curve 1 of FIG. 1. About 30 seconds after the maximum of about $14\times10^{-3}$ mb has been reached, the pressure will decay again by more than one order of magnitude to the average or remaining gas pressure. The maximum value of the pulse is proportional to the quantity of sodium azide which is being dissociated, and inversely proportional to the pumping energy and the volume of the melt furnace.

The pressure within the furnace is monitored, and the pressure rise is registered by a manometer, which, likewise, will be responsive to the decay of the pressure pulse to the value before the pressure pulse occurs. When this pressure pulse has decayed, a signal is generated which acts as a trigger for the second stage of heating, namely of the melting-in phase. The duration of the pre-heating phase, thus, is not determined initially. After the pressure has decayed, which is indicative of termination of dissociation of the $NaN_3$, the temperature at the first end of the vessel has risen to about 350° C. Further rise is inhibited by introducing xenon gas into the furnace and into a cooling or heat dissipation bridge, schematically indicated in FIGS. 1 and 2 by arrow A. At the same time, heating energy is increased by raising the heating voltage from 16 V to 18 V, so that heating energy and the temperature at the second end increases, whereas the first end will be subjected to a temperature drop—see FIG. 2.

Due to the higher heat power being supplied, the temperature at the upper end of the vessel will rise above the melting point of the glass solder or glass melt and, after about 30 seconds, the glass melt will become liquid, melt, and will seal the electrode system at the end of the vessel-see arrow B in FIG. 1.

Up to this point, the xenon pressure within the interior of the discharge vessel has long since stabilized itself. Determinative for the effectiveness of cooling is the distance between the wall of the vessel from the wall of the bore. In the example described, this distance is about 0.25 mm. A few experiments can readily determine appropriate distances for other sizes of vessels. The actual melting-in phase has a duration of about 3 minutes. After the melting-in phase is completed, the discharge vessel is permitted to cool, for example within the furnace.

Figure 3:
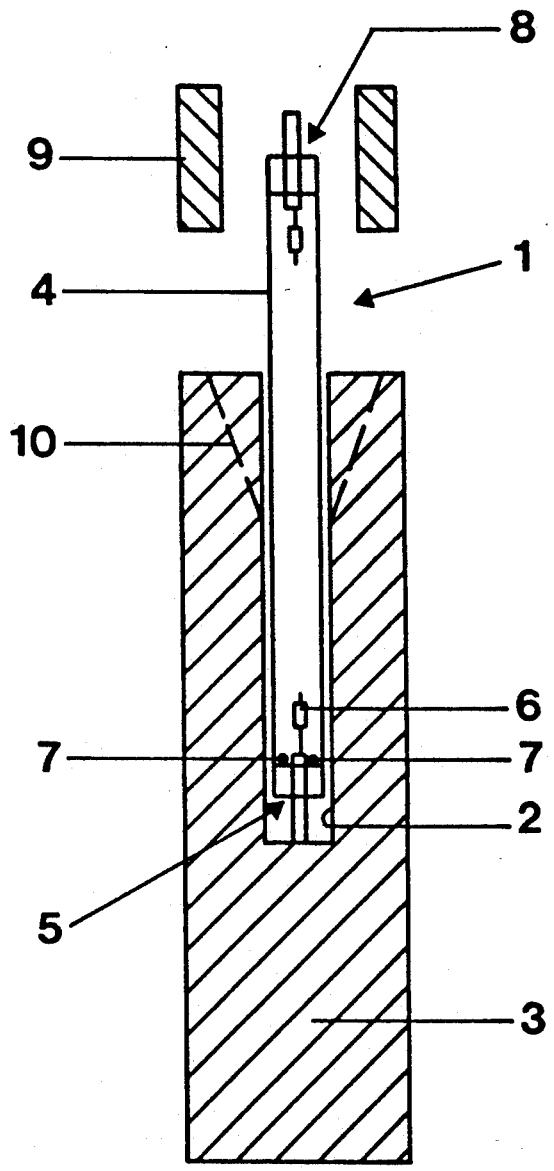
FIG. 3 is a highly schematic cross-sectional view of a holder or reception rail for a discharge vessel, having a discharge vessel fitted therein.

FIG. 3: The holder for vessel 1 is a metallic reception rail 3, formed with a bore 2 therein. The ceramic tube of the discharge vessel 1, in the embodiment selected, has a length of 57 mm—without the electrode systems. It is fitted into the bore 2 over a length of 38 mm, leaving an upper portion 4 of 19 mm length of the vessel which extends above the upper side of the reception rail 3. The discharge vessel 1 has an outer diameter of 4.5 mm. The diameter of the bore 2 within the rail 3 is 5 mm. The lower end 5 of the vessel already retains a vacuum-tightly melted-in electrode system 6. Four sodium azide pellets 7 of 2 mg each are located within the vessel 1, which were previously filled into the vessel before the vessel was introduced into the melting furnace. The second electrode system, which includes the pumping tube in form of an open niobium tube, and also retains a glass solder or glass melt ring, is then seated on the second end of the vessel.

A second example relates to the manufacture of a discharge vessel for a lamp having a power rating of 400 W made in accordance with the first embodiment. At this power rating the discharge vessel is about twice as long as that of a 70 W lamp so that the heat conduction from the upper end of the vessel to the lower end thereof takes a relatively longer time. It is preferable, therefore, to enlarge the upper end of the bore in a V-shape as shown by the broken line of FIG. 3 (reference number 10). More thermal radiation is thus reflected from the heater 9 towards the vessel 1.

A third example relates to the manufacture of a discharge vessel made in accordance with the second embodiment and is illustrated by way of the FIGS. 4 and 5. The lamp has a power rating of 70 W and its second electrode system is provided with an exhaust tube in the form of a niobium tube having an opening thereon. Unless indicated otherwise, the steps of the process are the same as those of the first embodiment. Subsequent to the sealing of the first electrode system and the filling of the sodium azide pellets, the second electrode system together with the glass solder or glass melt ring is fitted.

The second end 8 of the vessel is heated within a glove box in the furnace at a high rate, for example a heating voltage of 20 V, see curve II, section a of FIG. 4, so that the temperature at the second end of the vessel soon reaches the melting temperature of the glass solder and exceeds this temperature at about 1300° C., see the solid line curve of FIG. 5. At the same time, the temperature at the remote or first end of the vessel also rises rapidly, as in the first example, see broken line curve of FIG. 5. When the melt seal is tight, arrow B of FIG. 4, the heating energy is decreased, see arrow C in FIGS. 4 and 5, and the temperature at the second end will fall below the solidification temperature of the glass melt, see section b of FIG. 5. The temperature at the first end of the vessel continues to rise, however, although at a lower rate, until the sodium azide begins to dissociate, and the pressure rise is recorded, see curve I of FIG. 4. When the pressure has decayed to the base or remaining pressure, heating is disconnected and at the same time argon is introduced into the melt furnace, arrow A of FIGS. 4 and 5. This results in a cold connection to the receptor rail or holder at the first end and leads to a rapid drop of temperature thereat, section c of FIG. 5, thereby preventing vaporization of the sodium which has been formed.

After gradual cooling of the vessel to room temperature, the vessel is removed from the furnace. The cooling gas, argon, can then be pumped off, and a suitable ignition gas, for example xenon, can be filled into the vessel through the pumping tube or stub, and, thereafter, the pumping tube or stub is closed off or tipped off within the glove box.

Various changes and modifications may be made and any features disclosed herein may be used with any of the others, within the scope of the present invention.

I claim:

1. A method of making a discharge vessel of a sodium high-pressure discharge lamp, comprising the steps of a1) providing a ceramic discharge vessel having two open ends;

a2) providing two electrode systems and a glass melt or glass solder mass on each system;

b) introducing one of the electrode systems into one open end of the vessel and melt-sealing the electrode system into said vessel by means of the glass melt or glass solder mass to form a subassembly;

c) introducing a fill which includes sodium by introducing $NaN_3$ through the second end of the vessel;

d1) fitting the second electrode system on the second end of the vessel;

d2) introducing the subassembly into a vacuum chamber;

d3) while the vessel is in the vacuum chamber, heating said second end;

d4) while carrying out the heating step of d3), monitoring the pressure arising in the vessel and sensing the occurrence of a sharp pressure pulse indicative of dissociation of the $NaN_3$;

e) awaiting decay of the pressure pulse and, while the vessel is in the vacuum chamber, then introducing a noble gas or mixture of noble gases into the vessel;

f) after step d2), melt-sealing the second electrode system to the vessel; and g) cooling the discharge vessel.

2. The method of claim 1, wherein said gas or gas mixture has the dual function of an ignition gas within the fill of the lamp and a cooling gas for said first end of the vessel;

and wherein both electrode systems are devoid of communication between the interior of said vessel and the outside thereof;

and wherein said method steps d3) and e) are carried out as follows:

d3) heating said second end of the vessel to a temperature below the melting point of the glass solder or melt mass;

e1) introducing the combination ignition and cooling gas or gas mixture through the still open second end;

e2) increasing heating energy to melt the glass solder or glass melt mass at the second end; and e3) finishing the melt seal between the second end of the vessel and the second electrode system.

3. The method of claim 2, wherein the temperature in step d3) is about 50° C. below the melting temperature of the glass solder or glass melt mass.

4. The method of claim 2, wherein the steps e1) and e2) are carried out simultaneously.

5. The method of claim 1, wherein the second electrode system includes a pump or exhaust tube or stub, and in which said gas has the function of a cooling gas for the first end of the discharge vessel;

and wherein said steps d) and e) are carried out as follows:

d3A) heating of the second end of said vessel to a temperature above the melting point of the glass solder or glass melt mass until the second electrode system is melt-sealed in the second end of the discharge vessel;

d3B) decreasing heating energy, so that the temperature of the second end drops below the solidification temperature of the glass solder or melt mass;

d5)terminating heating; and e) introducing the cooling gas; and further including an additional step h) which comprises h) removing the discharge vessel from the vacuum chamber and introducing an ignition gas or gas mixture through said pumping or exhaust tube or stub and thereafter closing off the pumping or exhaust tube or stub.

6. The method of claim 5, wherein the steps d5) and e) are carried out simultaneously.

7. The method of claim 1, wherein the $NaN_3$ is introduced as a solid in the form of granules, pills or pellets.

8. The method of claim 1, wherein said gas comprises xenon and said gas mixture comprises a mixture of neon and argon.

9. The method of claim 5, wherein the cooling gas comprises argon and the ignition gas comprises xenon.

10. The method of claim 5, wherein said step (h) further comprises introducing additives into the vessel through said pumping or exhaust tube or stub.

11. The method of claim 1, wherein the steps a) to d1) are carried out in air.

12. The method of claim 1, wherein the steps d3) to f) are carried out in a vacuum melt furnace.

13. The method of claim 1, wherein the vacuum chamber includes a vacuum furnace; and wherein said step of monitoring the pressure arising in the vessel and sensing the occurrence of a sharp pressure pulse comprises sensing change in the vacuum within the vacuum furnace.

14. The method of claim 1, including the step of introducing the discharge vessel into a reception rail or holder structure at the earliest at the step b) and at the latest at the step d3).

15. A method of making a discharge vessel of a sodium high-pressure discharge lamp, comprising the steps of a1) providing a ceramic discharge vessel having two open ends;

a2) providing two electrode systems and a glass melt or glass solder mass on each system;

b) introducing one of the electrode systems into one open end of the vessel and melt-sealing the electrode system into said vessel by means of the glass melt or glass solder mass to form a subassembly;

c) introducing a fill which includes a sodium compound capable of dissociating into sodium while liberating a gas;

d1) fitting the second electrode system on the second end of the vessel;

d2) introducing the subassembly into a vacuum chamber;

d3) while the vessel is in the vacuum chamber, heating said second end;

d4) while carrying out the heating step of d3), monitoring the pressure arising in the vessel and sensing the occurrence of a sharp pressure pulse indicative of dissociation of the sodium compound;

e) awaiting decay of the pressure pulse and, while the vessel is in the vacuum chamber, then introducing a noble gas or mixture of noble gases into the vessel;

f) after step d2), melt-sealing the second electrode system to the vessel; and g) cooling the discharge vessel.

16. The method of claim 15, wherein said step d4) is carried out in a vacuum furnace and the step of monitoring the pressure in the vessel comprises sensing change of vacuum pressure in the furnace.

17. The method of claim 15, wherein said gas or gas mixture has the dual function of an ignition gas within the fill of the lamp and a cooling gas for said first end of the vessel;

and wherein both electrode systems are devoid of communication between the interior of said vessel and the outside thereof;

and wherein said method steps d3) and e) are carried out as follows;

d3) heating said second end of the vessel to a temperature below the melting point of the glass solder or melt mass;

e1) introducing the combination ignition and cooling gas or gas mixture through the still open second end;

e2) increasing heating energy to melt the glass solder or glass melt mass at the second end; and e3) finishing the melt seal between the second end of the vessel and the second electrode system.

18. The method of claim 17, wherein the temperature in step d3) is about 50° C. below the melting temperature of the glass solder or glass melt mass.

* * * * *